US005148919A

United States Patent [19]

Rubin

[11] Patent Number: 5,148,919

[45] Date of Patent: Sep. 22, 1992

[54] BLOOD TUBE SAFETY BOX

[75] Inventor: David H. Rubin, New Rochelle, N.Y.

[73] Assignee: Kevin J. Kitson, White Plains, N.Y. ; a part interest

[21] Appl. No.: 701,813

[22] Filed: May 17, 1991

[51] Int. Cl.[5] ..... B65D 85/20

[52] U.S. Cl. ..... 206/443; 206/477; 206/563; 206/521; 206/829; 211/71; 211/74

[58] Field of Search ..... 206/443, 483, 486, 562, 206/563, 570, 521, 829, 477; 211/71, 74, 76

[56] References Cited

U.S. PATENT DOCUMENTS

| | | | |
|---|---|---|---|
| 1,739,801 | 12/1929 | Pitts | 206/829 |
| 2,725,782 | 12/1955 | Worley | 211/74 |
| 3,175,695 | 3/1965 | Goodman et al. | 211/74 |
| 3,464,567 | 9/1969 | Gowdy et al. | 211/74 |
| 3,474,913 | 10/1969 | Jungner et al. | 211/74 |
| 3,643,812 | 2/1972 | Mander et al. | 211/74 |
| 3,918,920 | 11/1975 | Barber | 211/74 |
| 3,941,237 | 3/1976 | MacGregor, Jr. | 211/74 |
| 4,001,444 | 1/1977 | Clarke | 211/74 |
| 4,040,234 | 8/1977 | Stockdale et al. | 211/76 |
| 4,068,798 | 1/1978 | Rohde | 211/74 |
| 4,124,122 | 11/1978 | Emmitt . | |
| 4,207,289 | 6/1980 | Weiss | 211/74 |
| 4,240,547 | 12/1980 | Taylor | 206/443 |
| 4,284,603 | 8/1981 | Korom | 211/74 |
| 4,411,868 | 10/1983 | Noack | 211/71 |
| 4,453,639 | 6/1984 | Sharma | 211/74 |
| 4,510,119 | 4/1985 | Hevey | 206/443 |
| 4,534,465 | 8/1985 | Rothermel et al. . | |
| 4,742,910 | 5/1988 | Staebler . | |
| 4,754,883 | 7/1988 | Grzywa | 211/71 |
| 4,787,523 | 11/1988 | Kalous . | |
| 4,826,003 | 5/1989 | Levy | 206/443 |
| 4,840,618 | 6/1989 | Marvel . | |
| 4,848,542 | 7/1989 | Burnette et al. | 206/829 |
| 4,925,630 | 5/1990 | Grunwald . | |
| 4,929,427 | 5/1990 | Guala . | |
| 4,982,850 | 1/1991 | Mears . | |
| 4,997,090 | 3/1991 | Lenmark, Sr. et al. | 206/443 |
| 5,047,019 | 9/1991 | Sincock | 206/486 |

*Primary Examiner*—David T. Fidei
*Attorney, Agent, or Firm*—James G. Gatto

[57] ABSTRACT

According to the present invention, there is provided a durable, lightweight disposable container containing a plurality of holders for holding blood product tubes. These tubes are firmly secured in each slot yet can be easily removed from the slot after filling. According to a preferred embodiment, the box can be fixed to a table top or other substantially flat surface in an area where the blood drawing procedure is to occur.

4 Claims, 2 Drawing Sheets

BLOOD TUBE SAFETY BOX

FIELD OF THE INVENTION

The present invention relates to a blood tube safety box and more particularly, to an apparatus for simplifying and improving the safety of fluid transfer processes.

BACKGROUND OF THE INVENTION

The epidemic of acquired immunodeficiency syndrome (AIDS) has led health care workers to focus on the risk they face in the hospital and clinic environments. In the U.S., nearly 150,000 cases of AIDS in adults and adolescents were reported through July 1990.

In addition to AIDS, hospital workers have reason to be concerned about other illnesses they may be exposed to in the workplace. The Hepatitis Branch of the Centers for Disease Control has estimated that hundreds of health care workers die each year from the direct or indirect consequences of occupationally acquired hepatitis B. Additionally, thousands more become infected with the virus. Other studies have documented the transmission of at least 20 different pathogens by "needlestick" injuries. Needlestick injuries can occur, for example, in the process of collecting and/or transferring bodily fluids.

Despite the presumed widespread knowledge of the potential dangers of needlesticks, the incidence of these injuries is increasing. Furthermore, although the number of incidents of transmission of the HIV virus after a needlestick is relatively low (currently estimated to be less than 4/1000 needlesticks), infections in health care workers have been attributed to needlestick exposures. Not only are the medical consequences of needlesticks worrisome, the psychological consequences of unnecessary needlesticks are ever present for health car workers and their spouses or sexual partners.

Needlestick injuries effect all hospital personnel and occur throughout hospitals. Virtually every type of hospital personnel has sustained a needlestick injury at one time or another. This includes nurses, doctors, technicians, and housekeeping personnel. In addition, virtually every ward and department has been the site of needlesticks. Of further concern is the fact that in one study only 54% of those personnel who were victims of needlesticks reported the incident. In a large majority of cases, accidental needlesticks occurred during blood drawing procedures. In view of the foregoing, it is readily apparent that the risk of needlestick injuries and the concomitant transfer of potentially life threatening pathogens is a constant threat to hospital and clinical personnel.

Attempts have been made to address this problem, especially in the area of transferring bodily fluids from a syringe to a test tube. One such device is disclosed in U.S. Pat. No. 4,840,618 issued to Marvel. The Medical Safety Device disclosed in Marvel comprises a round elongated handle sized for being held in the fisted grip of a person. This handle loosely receives a test tube. A shield is positioned on top of the handle and extends radially outwardly therefrom to an extend sufficient to substantially shield the fisted hand of the person gripping the handle. It is further disclosed that there is an opening in the side of the handle to permit the test tube to be contacted to facilitate its ejection from the cavity in the handle, and to permit the test tube to be held in place while a syringe needle is extracted from the test tube to prevent slippage of the tube from the handle. A small opening in the end of the handle prevents a vacuum from forming between the bottom of the test tube and the bottom of the test tube cavity in the handle.

While Marvel provides a certain degree of safety with the shield, additional drawbacks exist. The need to hold the test tube through the opening in the handle can lead to further problems. For example, in the event the user's hand slips, it is possible that a tube could be pulled out of the holder while attempting to extract a needle. This could lead to breakage of the tube and/or spillage of the fluid. Additionally, if too much pressure is asserted on the side of the wall by the user, it is possible that the tube will break causing cuts and a possible transfer of pathogens to the holder of the tube. Also, if any blood is on the outside of the tube undersirable contact can occur. Moreover, this structure necessitates that the user's hand (other than the hand holding the needle) be in the vicinity of the needle which is dangerous even with the shield present. This is obviously undersirable.

Additionally, this structure only enables a single tube to be held. In certain instances, it is necessary or desirable to transfer fluids into or from a plurality of tubes.

A structure similar to Marvel is also disclosed in U.S. Pat. No. 4,742,910 issued to Staebler.

In U.S. Pat. No. 4,982,850 issued to Mears there is shown another hand held test tube holder structure. This device includes a base 12 which is designed to allow the test tube holder to stand independently on "balancing" pads 26, 28 and 30. These balancing pads are undesirable since they permit a holder to slide along a surface or allow the holder to be easily knocked over. These are considered undesired movements. Each of the shafts 14–22 which hold the tubes, has a corresponding frontal slot 32–40, respectively. It is specifically disclosed that the shafts have a series of holes 42–50 aligned therewith to enable the test tubes or vials to be loosely inserted into the holder. This is undesirable since a tube can easily slide out of the holder.

It is disclosed that, in use, the user typically receives one or more vials that are already filled with blood samples that may be infected with the AIDS virus, and inserts the vials into the vertical shafts. There, they are stored until the user desires to transfer a fluid sample. After choosing the vial from which or to which a sample is to be transferred, the user places his thumb through the corresponding slot and presses the vial against the back of the corresponding shaft. A sample is removed from that vial by tilting the holder and needle toward one another and inserting the needle into the vial's top. This test tube holder is similar to Marvel in that it provides a safety shield at the top, it is hand held and the user contacts the tubes through a hole in the shaft to hold them in place. In at least one respect it differs from Marvel since it is designed for holding a plurality of tubes.

Therefore, this invention also suffers from many of the drawbacks of Marvel's device since the user must contact the vial to hold it in place while a needle is being withdrawn and further, because it requires a user's hand to contact the tubes and be near the needle, it must be tilted towards the needle and the tubes fit loosely into the vertical shafts.

Of course, various types of test tube racks and holders in general are known in the prior art, but to the knowledge of the applicant, none have been designed in order to facilitate and improve the safety of fluid transfer or address the other objects of the present invention.

SUMMARY OF THE INVENTION

It is, therefore, an object of the present invention to overcome these and other drawbacks of the prior art.

It is a further object of the present invention to avoid the need to contact a fluid container or a housing for a fluid container during a fluid transfer process.

It is a further object of the present invention to improve the safety and efficiency of fluid transfer processes.

It is a further object to enable efficient transport of a plurality of tubes after a fluid transfer process without having to contact the tubes.

These and other objects of the present invention are achieved by using a blood tube safety box which reduces the risk of needlesticks during high risk procedures involving fluid transfers. For simplicity, the present invention will be described in connection with blood transfer to and from test tubes. However, it is to be understood that the invention is not so limited.

According to the present invention, there is provided a durable, lightweight disposable container containing a plurality of holders for holding blood product tubes. These tubes are firmly secured in each slot yet can be easily removed from the slot after filling. According to a preferred embodiment, the box can be placed on a table top or other substantially flat surface in an area where the blood drawing procedure is to occur. Preferably, the box is secured to the table by suction cups or other fixation means. Once blood is drawn from a patient, for example, it can be transferred directly to the tubes secured in the box which is firmly affixed to the table. No physical contact with the tubes is necessary. The vacuum present in each tube automatically draws the blood into the tube until the desired amount of fluid fills the tube. After inserting fluid into one tube, the needle (e.g., syringe) can be withdrawn and placed in the next tube without contacting the tube or box and without fear of the tube being lifted out of the holder, and without contact by the person performing the job.

The blood tube safety box according to the present invention can be inexpensively made and constructed of a plastic material (e.g., polypropylene). This enables it to be economically disposable. However, other materials could be used according to desired characteristics and performance.

While the invention is not so limited, each patient could be assigned his or her own box after the decision to obtain blood products has been made. After completion of (or before) blood drawing, the box with the patient's name and with the tubes firmly located therein can be transported to a lab or other facility for analysis without having to contact the tubes.

DETAILED DESCRIPTION OF THE PREFERRED EMBODIMENTS

Figure 1:
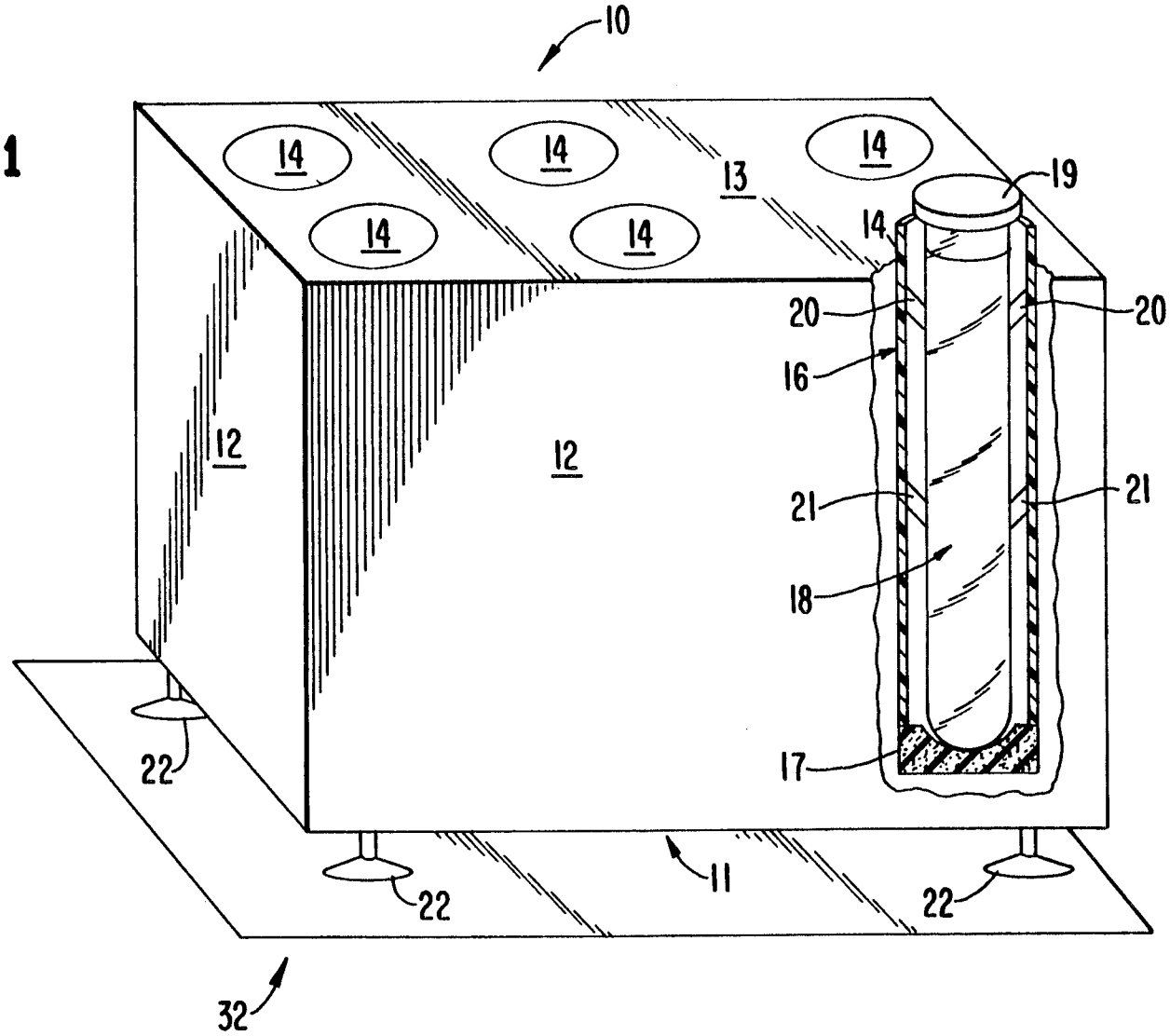
FIG. 1 is a schematic illustration of a blood tube safety box according to the present invention with a partial sectional view of a holder for the test tube.

With reference to FIG. 1 there is shown a blood tube safety box according to one embodiment of the present invention. This structure comprises a housing which is generally indicated by reference numeral 10. Housing 10, which may be formed in a variety of different geometric configurations, is shown in the preferred embodiment as being a substantially rectangular housing having a base 11 with four side walls 12 (two of which are visible in FIG. 1) extending upwardly therefrom and a top portion 13 connected to an upper portion of the side walls 12. The side walls 12 are each connected to form a substantially 90° angle thereby defining the sides of the rectangular housing.

A plurality of openings 14 are formed in the top portion 12. While six openings are shown in the embodiment of FIG. 1, more or less may be used as desired. Additionally, the size of these openings can vary. Preferably, they are at least as large as the size of a test tube (or other type of fluid container) which is to be inserted therein. A generally cylindrical holder 16 extends from each of the openings 14 substantially to the base portion 11 to form a housing 10. One such holder is shown in partial sectional view in FIG. 1. As shown in FIG. 1, the cylindrical holder extends from and is attached to the top portion 12 in a manner readily apparent to one of ordinary skill in the art. As shown in FIG. 1, a test tube 18 is inserted into the holder 16.

According to one novel aspect of the present invention, there is provided a plurality of projections 20, 21 which are connected at one end to the inner walls of holder 16 and which at the other end, engage the tube 18 having a stopper 19 which is inserted therein. These projections are preferably in groups (e.g., 20, 21) wherein each group comprises two or more portions extending radially inward from the holder 16. As shown in FIG. 1, there are two groups of projections 20, 21 with two projections in each group. Of course, more or less portions may be provided in each group and more than two groups can be provided. The groups may be positioned at various vertical positions within the holder and the portions may be positioned at various radial positions corresponding to these vertical positions. The portions 20, 21 are appropriately sized to engage the tube which is inserted therein.

For example, a number of standard size test tubes are currently available. The portions 20, 21 are preferably sized to extend from the inner wall of holder 16 to contact the outer surface of the smallest test tube that would be used with a particular holder. As slightly larger tubes are used, the portions are deflected downward due to insertion of the tube. For this purpose, it is convenient to make the portions 20 resiliently deformable to thereby provide engagement with the tube by the projections to firmly hold the tube in place. Preferably, the portions 20, 21 are directed at an angle of 25° with respect to vertical axis the holder 16 and the end which contacts the tube 18 can be flat or curved. However, this range can be varied as desired and this angle can be virtually anywhere from 5° to 90°. The portions 20, 21 can be designed to provide a holding force on the test tube which is sufficient to prevent the test tube from being slid out of the holder while a needle is being extracted from the tube during an extraction or insertion process. Also, the number of groups and the number of portions in each group can be selected to further achieve this goal. Preferably, three equiangularly spaced gripper portions can be provided in each group. In this way different size test tubes can be held firmly in place. This avoids the need for a user to place his hand on the tube while withdrawing a needle.

Alternatively, or in addition, one or more metal clips may be located at or near the top of the holder 16 to firmly hold the tube in place while enabling the tube to be withdrawn from the holder only when desired.

At the bottom of the holder 16, a foam rubber or other type of cushioning device 17 can be provided to establish a positive stop position for the test tube thereby establishing a vertical position of the tube. Device 17 also cushions the tubes against vibrations or other forces which may occur during transportation of the tubes (in the housing) which could shatter or otherwise damage the tubes.

According to another novel aspect of the present invention, there are provided a plurality of fixation elements 22 which extend downwardly from the outer surface of the base portion 11 of the housing 10. Preferably these elements 22 comprise suction cup-like devices for enabling the box to be removably fixably secured to a table 32 or other support surface. Alternatively, the elements may comprise pads made of non-skid rubber or other suitable materials. As will be apparent to one of ordinary skill in the art, other structures can be used to firmly fix the housing onto a support surface and to prevent it from being slid along the surface. By this combination of features, only one hand is needed to accomplish the fluid transfer process and no contact with the tubes or housing is necessary. In this way, accidental needlesticks can be effectively prevented.

Figure 2:
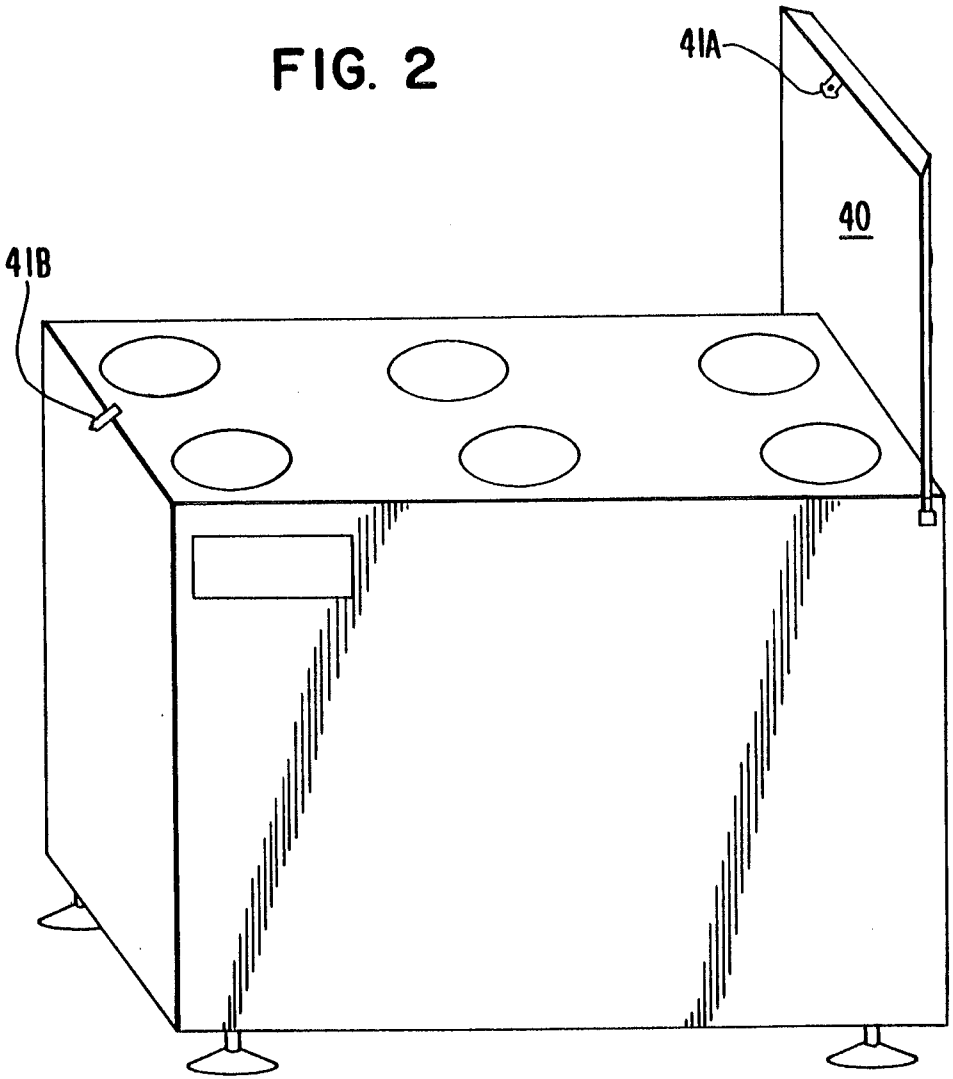
FIG. 2 is a schematic illustration of a blood tube safety box according to FIG. 1 with a cover attached.

According to another embodiment of the present invention as shown in FIG. 2, a cover 40 may be pivotably attached to top portion 13 of the holder 10 or to an upper portion of one or more side walls 12 to enable the housing 10 containing tubes 18 to be covered during transport. This avoids the need for separate packaging and avoids the need to withdraw the tubes from the housing for transport. Moreover, after transport, the tubes still do not need to be withdrawn to perform an analysis of the contents. Rather, since the tubes 18 are firmly secured in the holder 16, a needle, for example, may be inserted into the tube to extract the fluid for sampling. An important aspect of the invention is that it does not require two hand operation when needles are around. Various other types of cover arrangements can also be used as will be readily apparent to one of ordinary skill in the art.

Of course, if desired, the tube can be withdrawn for analysis. Preferably, a standard, or specially designed clamp can be used to remove the tube to further avoid the need for the user to contact the tube. Or, this may be done by hand since no needle is used at this time.

According to another embodiment, a security device can be associated with the cover and the housing to secure the contents of the tubes. For example, a lock (41*a*, 41*b*) or other types of security devices may be used where such a feature is desirable or necessary, as shown, for example, in FIG. 2.

Preferably, housing 10 and holder 16 are formed of polypropylene. The fluid container 18 may be a test tube or any other suitable fluid container. As shown in FIG. 1, the tube is glass, however, the invention is not so limited. If a test tube is used, the tube may contain a rubber stopper 19 to seal the tube. In this case, a needle is inserted through the rubber stopper 19 to either deposit or withdraw fluid to or from the tube in a known manner. As mentioned above, while various preferred embodiments discuss a test tube for holding blood, the invention is not so limited. Various other types of fluid containers may be used and may hold other types of fluids. The cushioning element 17 may be adapted to cause the fluid container 18 to extend a predetermined amount above the top portion 13. Various different sizes of openings and heights for the container may be used based on the type of tubes or fluid containers that are to be used. The portions 20 can be of a plastic or rubber type material or another type of suitable material.

The foregoing is a description of the preferred embodiments. Various other alternatives will be readily apparent to one of ordinary skill in the art. The invention is only limited by the claims which are appended hereto.

What is claimed is:

1. A housing for a plurality of fluid receptacles wherein said housing is designed to avoid the need for a user to hold the housing or said fluid receptacles during a fluid transfer process, said housing comprising:

top, bottom and side walls attached to form an enclosure;

said top wall comprising a plurality of openings adapted to receive one of said plurality of fluid receptacles;

a plurality of holders, wherein each of said holders extend downwardly from one of said openings in said top wall to a position adjacent said bottom wall;

engaging means in contact with each of said holders for engaging a fluid receptacle located therein and for removably securing said fluid receptacle within said holder;

fixation means projecting from said bottom wall for removably fixing said housing on a support surface to prevent undesired horizontal or vertical movement of the housing with respect to said support surface; and a cover pivotably attached to one or more walls of said housing wherein said cover is pivotably attached to said top wall of said housing.

2. A housing for a plurality of fluid receptacles wherein said housing is designed to avoid the need for a user to hold the housing or said fluid receptacles during a fluid transfer process, said housing comprising:

top, bottom and side walls attached to form an enclosure;

said top wall comprising a plurality of openings adapted to receive one of said plurality of fluid receptacles;

a plurality of holders, wherein each of said holders extend downwardly from one of said openings in said top wall to a position adjacent said bottom wall;

engaging means in contact with each of said holders for engaging a fluid receptacle located therein and for removably securing said fluid receptacle within said holder;

fixation means projecting from said bottom wall for removably fixing said housing on a support surface to prevent undesired horizontal or vertical movement of the housing with respect to said support surface; and a cover pivotably attached to one or more walls of said housing further comprising locking means for locking said cover to said housing to prevent tampering with the contents of said fluid receptacles.

3. A container for holding test tubes adapted to enable a user to insert and withdraw a needle into and from said test tubes without manual manipulation of the test tube or container during the needle insertion or withdrawal process to thereby reduce the risk of needlesticks to said user, said container comprising:

top, bottom and side walls forming a substantially rectangular enclosure;

a plurality of openings formed in said top wall, said openings being sized at least as large as a diameter of said test tubes;

a plurality of holders for receiving and holding a plurality of test tubes, each of which is associated with a respective one of said openings and which extends downwards from said respective opening, wherein said holders are substantially cylindrical and have attached thereto resiliently deformable projection means for securely holding test tubes having different diameters, said projection means extending radially inwards and downwards to resist upwards force placed on a test tube, said holders further comprising cushion means located at a bottom portion thereof to cushion said test tubes and vertically located said test tubes; and fixation means for removably securably fixing said container on a supporting surface.

4. The container of claim 3, further comprising cover means extending over said top surface and enclosing any test tubes within the container for preventing tampering with samples within the test tubes.

* * * * *